US008360418B2

(12) United States Patent
Matsuyama et al.

(10) Patent No.: US 8,360,418 B2
(45) Date of Patent: Jan. 29, 2013

(54) SHEET SUPPLYING DEVICE AND IMAGE FORMING APPARATUS INCORPORATING SAME

(75) Inventors: Yasuo Matsuyama, Hyogo (JP); Takamitsu Ikematsu, Osaka (JP); Kaoru Tada, Osaka (JP); Ippei Kimura, Osaka (JP); Ikuo Fujii, Osaka (JP)

(73) Assignee: Ricoh, Company, Ltd., Tokyo (JP)

( * ) Notice: Subject to any disclaimer, the term of this patent is extended or adjusted under 35 U.S.C. 154(b) by 0 days.

(21) Appl. No.: 13/137,719

(22) Filed: Sep. 7, 2011

(65) Prior Publication Data

US 2012/0061907 A1 Mar. 15, 2012

(30) Foreign Application Priority Data

Sep. 14, 2010 (JP) ..... 2010-205944

(51) Int. Cl.
*B65H 1/00* (2006.01)

(52) U.S. Cl. ..... 271/162

(58) Field of Classification Search ..... 271/162; 399/393

See application file for complete search history.

(56) References Cited

U.S. PATENT DOCUMENTS

| | | | | |
|---|---|---|---|---|
| 5,003,493 | A * | 3/1991 | Okada et al. | 399/388 |
| 5,413,409 | A * | 5/1995 | Arai | 312/330.1 |
| 5,975,517 | A * | 11/1999 | Lim | 271/117 |
| 6,015,148 | A * | 1/2000 | Cho | 271/164 |
| 6,612,564 | B1 * | 9/2003 | Todd | 271/145 |
| 7,472,904 | B2 * | 1/2009 | Park | 271/117 |
| 7,731,180 | B2 * | 6/2010 | Ohnishi | 271/164 |
| 7,862,034 | B2 * | 1/2011 | Kobayashi | 271/145 |

FOREIGN PATENT DOCUMENTS

| | | | |
|---|---|---|---|
| JP | 04-246030 | A | 9/1992 |
| JP | 05-000740 | A | 1/1993 |
| JP | 09-221236 | A | 8/1997 |
| JP | 2001-310825 | A | 11/2001 |
| JP | 2005-008342 | A | 1/2005 |
| JP | 2005-255363 | A | 9/2005 |
| JP | 2005-280980 | A | 10/2005 |
| JP | 2007-106545 | A | 4/2007 |
| JP | 2008-285264 | A | 11/2008 |

* cited by examiner

*Primary Examiner* — David H Bollinger
(74) *Attorney, Agent, or Firm* — Harness, Dickey & Pierce, P.L.C.

(57) ABSTRACT

A sheet supplying device that is incorporatable in an image forming apparatus includes a recording media container, a sheet feeding unit to feed a recording medium from the recording media container, a frame to support the recording media container and the sheet feeding unit, and a holder to hold the recording media container by surrounding an outer circumference of the recording media container. The recording media container is detachably attachable to the frame in a first operation in which the recording media container is moved in a direction parallel to a sheet conveyance direction and the recording media container is separated from the frame and the holder with the holder remaining in the frame, and a second operation in which the recording media container is moved in a direction perpendicular to the sheet conveyance direction and the recording media container is separated from the frame together with the holder.

18 Claims, 14 Drawing Sheets

SHEET SUPPLYING DEVICE AND IMAGE FORMING APPARATUS INCORPORATING SAME

CROSS-REFERENCE TO RELATED APPLICATIONS

The patent application is based on and claims priority pursuant to 35 U.S.C. §119 from Japanese Patent Application No. 2010-205944, filed on Sep. 14, 2010 in the Japan Patent Office, the entire disclosure of which is hereby incorporated by reference herein.

FIELD OF THE INVENTION

Embodiments of the present invention relate to a sheet supplying device that supplies a sheet-like recording medium to an image forming unit, and an image forming apparatus such as a laser printer, digital copier, facsimile machine and so forth, incorporating the sheet supplying device.

BACKGROUND OF THE INVENTION

Sheet supplying devices that can be incorporated in an image forming apparatus include a sheet supply tray or sheet supply cassette detachably attachable to the image forming apparatus that can accommodate an accumulated stack of recording media. The sheet supply tray is generally pulled out and inserted into a frame of the image forming apparatus through an opening formed in one side of the frame. That is, the sheet supply tray can be detachably attached in one direction only.

However, when an image forming apparatus is installed, some installation areas may have an obstacle or obstacles on the side to which the opening is provided. Therefore, in some recent approaches, a single sheet supply tray is configured to be detachably attachable to an image forming apparatus from two directions (as disclosed, for example, in Japanese Patent Application Publications Nos. 2005-255363 and 9-221236). According to this configuration, even if the sheet supply tray cannot be pulled out and inserted into the image forming apparatus from one direction, sheets or recording media accommodated in the sheet supply tray can be set from another direction.

Typically, in a configuration in which the sheet supply tray is detachably attachable to the image forming apparatus from two directions, the sheet supply tray can be slidably moved in a direction along a sheet conveyance direction and a direction perpendicular to the sheet conveyance direction. In this case, a guide mechanism is required at a position between the sheet supply tray and the frame of the image forming apparatus (containing side) to guide the sheet supply tray as it is detached from and attached to the image forming apparatus. Therefore, the frame may need to include one guide rail for guiding the sheet supply tray in the sheet conveyance direction and another guide rail for guiding the sheet supply tray in the direction perpendicular to the sheet conveyance direction.

Further, two different positioning mechanisms such as a stopper or the like for positioning the sheet supply tray when inserted in the image forming apparatus are required: One positioning mechanism for detaching and attaching the sheet supply tray in the sheet conveyance direction and another positioning mechanism for detaching and attaching the sheet supply tray in the direction perpendicular to the sheet conveyance direction.

In short, to enable detachment and attachment of the sheet supply tray with respect to the frame of the image forming apparatus in those two directions, guide rails, stoppers and other components or units for two directions may need to be provided to the frame of the image forming apparatus. This can make the configuration of the frame complicated and is not likely to make it more compact. Further, when the sheet supply tray is inserted into or removed from the image forming apparatus in one direction, the movement can be hindered by components such as a guide rail and a positioning stopper provided for movement in the other direction. Therefore, movement in both directions cannot be performed stably or reliably.

BRIEF SUMMARY OF THE INVENTION

The present invention describes a sheet supplying device and an image forming apparatus incorporating the sheet supplying device. In one example, a novel sheet supplying device includes a recording media container, a sheet feeding unit, a frame, and a holder. The recording media container accommodates a stack of recording media therein. The sheet feeding unit feeds a recording medium from the stack of recording media. The frame supports the recording media container and the sheet feeding unit therein. The holder holds the recording media container by surrounding the outer circumference of the recording media container. The recording media container is detachably attachable to the frame in a first operation and a second operation. In the first operation, the recording media container is inserted into or removed from the frame in a direction parallel to a sheet conveyance direction in which the recording medium is fed and conveyed upstream or downstream by the sheet feeding unit, and the recording media container is separated from the frame and the holder with the holder remaining in the frame. In the second operation, the recording media container is inserted into or removed from the frame in a direction perpendicular to the sheet conveyance direction, and the recording media container is separated from the frame together with the holder.

The holder may include a holder-side engaging member, and the recording media container may include a container-side engaging member. The container-side engaging member may engage with the holder-side engaging member when the recording media container is inserted into the frame in an attaching direction during the first operation. The container-side engaging member may disengage from the holder-side engaging member when the recording media container is removed from the frame in a detaching direction during the first operation.

The above-described sheet supplying device may further include a regulating unit to regulate detachment of the recording media container from the holder during the second operation of the recording media container with respect to the frame and in a state in which the recording media container is separated from the frame during the second operation.

The regulating unit may include a container-side anti-detachment member on the container and a holder-side anti-detachment member on the holder locked with the container-side anti-detachment member in an anti-detachment state. The anti-detachment state may be disabled to allow insertion and removal of the recording media container with respect to the frame during the first operation while the holder and the recording media container are attached to the frame. The container-side anti-detachment member and the holder-side anti-detachment member may be in the anti-detachment state to regulate detachment of the recording media container from the holder during the second operation of the recording media container with respect to the frame and in a state in which the recording media container is separated from the frame during the second operation.

The holder-side anti-detachment member of the regulating unit may be disposed upstream in the sheet conveyance direction from the center of the holder in the first operation. The container-side anti-detachment member may include a pivot shaft disposed upstream from the holder-side anti-detachment member in the sheet conveyance direction at a base portion of the container-side anti-detachment member around which the container-side anti-detachment member pivots to shift between the anti-detachment state and a detachment state in which the container-side anti-detachment member is unlatched from the holder-side anti-detachment member. In response to the insertion of the recording media container into the holder in the first operation, the container-side anti-detachment member may be pressed by the holder-side anti-detachment member to climb over the holder-side anti-detachment member.

The regulating unit may further include a biasing member to elastically bias the container-side anti-detachment member in a direction to produce the anti-detachment state.

The container-side anti-detachment member may remain separated from the holder in the first operation.

The container-side anti-detachment member may be surrounded by the recording media container.

The regulating unit may include a container-side anti-detachment member on the container and a holder-side anti-detachment member on the holder locked with the container-side anti-detachment member in an anti-detachment state. The holder-side anti-detachment member of the regulating unit may be disposed upstream in the sheet conveyance direction from the center of the holder in the first operation. The container-side anti-detachment member may include a pivot shaft disposed upstream from the holder-side anti-detachment member in the sheet conveyance direction at a base portion thereof around which the container-side anti-detachment member pivots to shift between the anti-detachment state and a detachment state in which the container-side anti-detachment member is unlatched from the holder-side anti-detachment member. In response to the insertion of the recording media container into the holder in the first operation, the container-side anti-detachment member may be pressed by the holder-side anti-detachment member to climb over the holder-side anti-detachment member.

The regulating unit may further include a biasing member to elastically bias the container-side anti-detachment member toward the anti-detachment state.

The regulating unit may include a container-side anti-detachment member on the container and a holder-side anti-detachment member on the holder, and a biasing member to elastically bias the container-side anti-detachment member toward an anti-detachment state in which the container-side anti-detachment member and the holder-side anti-detachment member are locked together.

The above-described sheet supplying device may further include a planar or shaft-like unlocking member to unlock the anti-detachment state of the recording media container with the holder remaining supported by the frame in the anti-detachment state by pressing the container-side anti-detachment member against an elastic force generated by the biasing member. The recording media container may be detached from the holder in the first moving direction in the detachment state with the regulating unit unlocked.

The unlocking member may be disposed in the frame to press the container-side anti-detachment member via a slit in the holder.

The unlocking member may be disposed upstream in the sheet conveyance direction from the holder-side anti-detachment member with the holder contained in the frame.

The above-described sheet supplying device may further include a regulating unit to regulate detachment of the recording media container from the holder during the second operation of the recording media container with respect to the frame and in a state in which the recording media container is separated from the frame during the second operation.

The above-described sheet supplying device may further include a guide mechanism to guide the recording media container in the detaching direction and the attaching direction during the first operation. The guide mechanism may include a guide rail on the recording medium container, and a guide rail guide on the holder to engage with the guide rail.

In another example, a novel image forming apparatus includes the above-described sheet supplying device, an image forming device to form an image on the recording medium fed from the sheet feeding device, and a sheet discharging device to discharge the recording medium with the image formed thereon.

BRIEF DESCRIPTION OF THE SEVERAL VIEWS OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
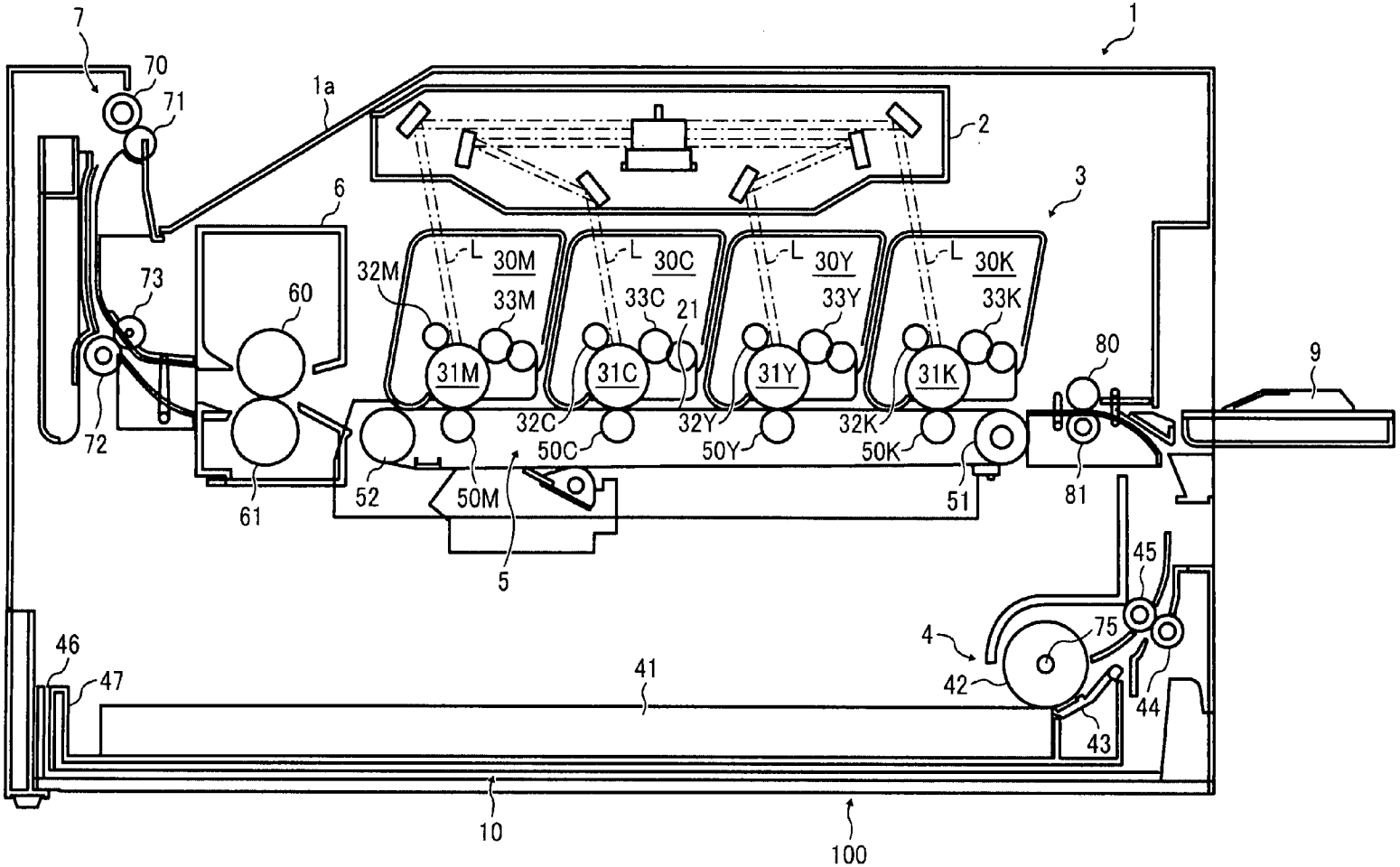
FIG. 1 illustrates a schematic configuration of an image forming apparatus including a sheet supplying device according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

[Embodiment]

FIG. 1 illustrates an image forming apparatus 1 employing an electrophotographic process to form color images using a general electrostatic image forming method. However, the present invention is not limited to this configuration.

The image forming apparatus 1 includes a sheet supplying device 100 located at a lower portion thereof, and an image forming device 3 located above the sheet supplying device 100 in the image forming apparatus 1.

As illustrated in FIG. 1, the sheet supplying device 100 includes a frame 10 containing a recording media container 47 and a sheet feeding unit 4.

The recording media container 47 accommodates a stack of recording media 41 therein.

The sheet feeding unit 4 contacts the stack of recording media 41 accommodated in the recording media container 47 from above to feed recording mediums from the stack of recording media 41.

The stack of recording media 41 is a bundle of multiple sheet-like recording media accumulated one after another.

The sheet feeding unit 4 includes a rotary shaft 75 and a sheet feeding roller 42. As the rotary shaft 75 of the sheet feeding roller 42 rotates, a recording medium placed on top of the stack of recording media 41 stored in the recording media container 47 is fed therefrom by the sheet feeding roller 42 and a separation pad 43 that serves as a sheet separation member disposed facing the sheet feeding roller 42. The separation pad 43 is disposed in the recording media container 47. The recording medium thus fed from the recording media container 47 is then conveyed by vertical conveying rollers 44 and 45 toward a registration roller 81. Then, the leading edge of the recording medium abuts against a nip contact area formed between the registration roller 81 and a registration tension roller 80 to align the leading edge of the recording medium. The registration roller 81 rotates to synchronize with movement of the recording medium to meet with the toner image at a transfer position of the toner image onto the recording medium.

The image forming device 3 includes a transfer belt unit 5 and four image forming units 30M, 30C, 30Y, and 30K. The transfer belt unit 5 is disposed to extend in a horizontal direction in the image forming apparatus 1. The four image forming units 30M, 30C, 30Y, and 30K are disposed horizontally above the transfer belt unit 5 along the upper portion of an endless transfer belt 21 to develop and form an image in each of the image forming units 30M, 30C, 30Y, and 30K, which serve as an image carrier.

The elements or components of the image forming units 30M, 30C, 30Y, and 30K are similar in structure and functions to each other, except that the image forming units 30M, 30C, 30Y, and 30K have different colors of toner, and therefore are also referred to as the image forming unit 30 in a singular form. For example, the image forming unit 30 (i.e., the image forming units 30M, 30C, 30Y, and 30K) includes a photoconductor drum 31 (i.e., photoconductor drums 31M, 31C, 31Y, and 31K), and image components are disposed around an outer circumferential surface of the photoconductor drum 31. The image components are, for example, a charging roller 32 (i.e., charging rollers 32M, 32C, 32Y, and 32K) for uniformly charging a surface of the photoconductor drum 31, a developing roller 33 (i.e., developing rollers 33M, 33C, 33Y, and 33K) for developing an electrostatic latent image formed on the surface of the photoconductor drum 31K into a visible toner image, a transfer roller 50 (i.e., transfer rollers 50M, 50C, 50Y, and 50K) for transferring the toner image onto a recording medium, and a cleaning unit (not illustrated) for cleaning the photoconductor drum 31 after transfer of the toner image onto the recording medium by removing residual toner from the surface of the photoconductor drum 31.

An optical writing unit 2 that serves as a light exposing unit is disposed above the image forming units 30M, 30C, 30Y, and 30K so as to emit laser light beams L toward the photoconductor drums 31.

The transfer belt unit 5 includes the endless transfer belt 21, a drive roller 52, and a driven roller 51. The transfer belt 21 is wound around the drive roller 52 and the driven roller 51.

The transfer rollers 50M, 50C, 50Y, and 50K are disposed in contact the inner loop of the transfer belt 21 at the upper portion thereof in a horizontal manner and facing the photoconductor drums 31M, 31C, 31Y, and 31K, respectively, with the transfer belt 21 interposed therebetween, so as to apply transfer bias to the transfer rollers 50M, 50C, 50Y, and 50K.

As the recording medium passes through the transfer belt unit 5 as described above, the image is transferred onto the recording medium. The recording medium having the image thereon is then conveyed to a fixing unit 6 to fix the image to the recording medium there.

The fixing unit 6 includes a fixing roller 60 that serves as a fixing member to fix the toner image to the recording medium and a pressure roller 61 disposed facing the fixing roller 60. Further, a heater that serves as a heating member is disposed inside the fixing roller 60. The pressure roller 61 contacts the fixing roller 60 at a predetermined pressure to form a fixing nip contact area.

The recording medium to which the image is fixed in the fixing unit 6 is conveyed to a sheet discharging device 7 and is then discharged with the printed surface down to a sheet discharging portion 1*a* that is formed at the upper portion of the image forming apparatus 1. The sheet discharging device 7 includes sheet conveyance rollers 72 and 73 and sheet discharging rollers 70 and 71. Further, the image forming apparatus 1 also includes a tray-type manual sheet feeder 9 to feed recording media from outside.

Next, a description is given of the sheet supplying device 100.

Figure 2:
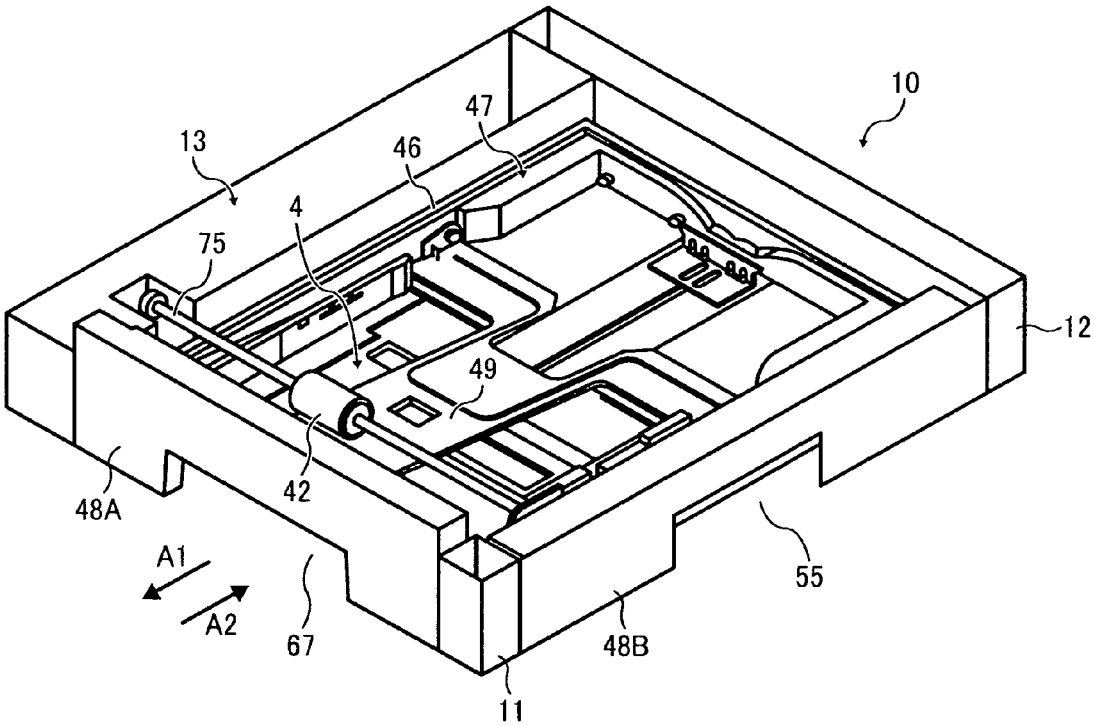
FIG. 2 is a perspective view illustrating the sheet supplying device of the image forming apparatus of FIG. 1.
Figure 3:
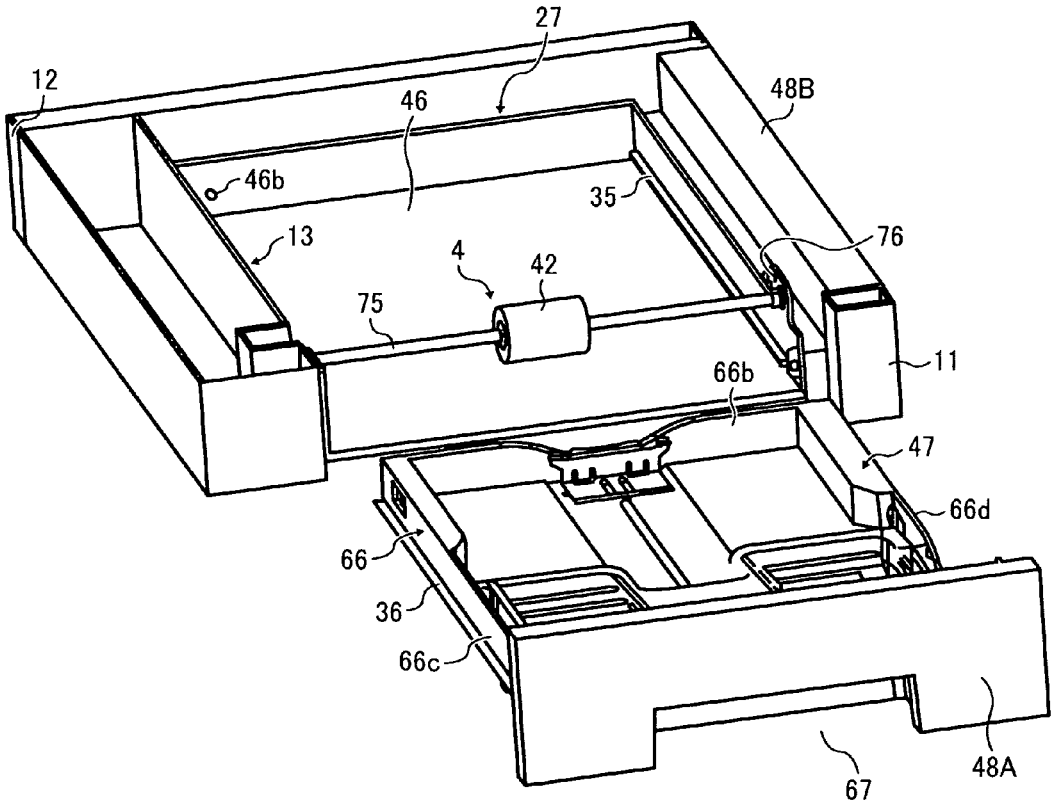
FIG. 3 is a perspective view illustrating the sheet supplying device of FIG. 2, in a state in which a recording media container is pulled in a sheet conveyance direction.

As previously described, the sheet supplying device 100 includes the recording media container 47, the sheet feeding unit 4, and the frame 10 that holds the recording media container 47 and the sheet feeding unit 4. FIG. 2 illustrates a configuration of the sheet supplying device 100, and FIG. 3 illustrates the configuration of the sheet feeding device 100 with the recording media container 47 removed therefrom. When the recording media container 47 is accommodated in the frame 10 of the sheet feeding device 100, the recording media container 47 is mounted on a holder 46.

With this configuration as illustrated in FIGS. 2 and 3, the recording media container 47 can be withdrawn from and inserted into the frame 10 in two different directions, which are a first direction and a second direction. The first direction corresponds to a sheet conveyance direction in which a recording medium is fed upstream or downstream by the sheet feeding unit 4. When the recording media container 47 is moved in the first direction, this action is referred to as a first detaching and attaching operation. Further, the second direction corresponds to a direction perpendicular to the sheet conveyance direction, that is, the first direction. When the recording media container 47 is moved in the second direction, this action is referred to as a second detaching and attaching operation. More specifically, a direction to pull out the recording media container 47 from the frame 10 of the sheet supplying device 100 during the first detaching and attaching operation is indicated by arrow A1 in FIG. 2 (hereinafter, also referred to as a "direction A1") and a direction to push the recording media container 47 into the frame 10 of the sheet supplying device 100 (to store the recording media container 47 therein) during the first detaching and attaching operation is indicated by arrow A2 in FIG. 2 (hereinafter, also referred to as a "direction A2"). In this case, the direction A1 indicates a detaching direction and the direction A2 indicates an attaching direction. Also, a direction to pull out the recording media container 47 from the frame 10 of the sheet supplying device 100 during the second detaching and attaching operation is indicated by arrow B1 in FIGS. 8B and 8C (hereinafter, also referred to as a "direction B1") and a direction to push the recording media container 47 into the frame 10 of the sheet supplying device 100 (to contain the recording media container 47 therein) during the second detaching and attaching operation is indicated by arrow B2 in FIGS. 8B and 8C (hereinafter, also referred to as a "direction B2"). In this case, the direction B1 indicates the detaching direction and the direction B2 indicates the attaching direction.

Figure 4:
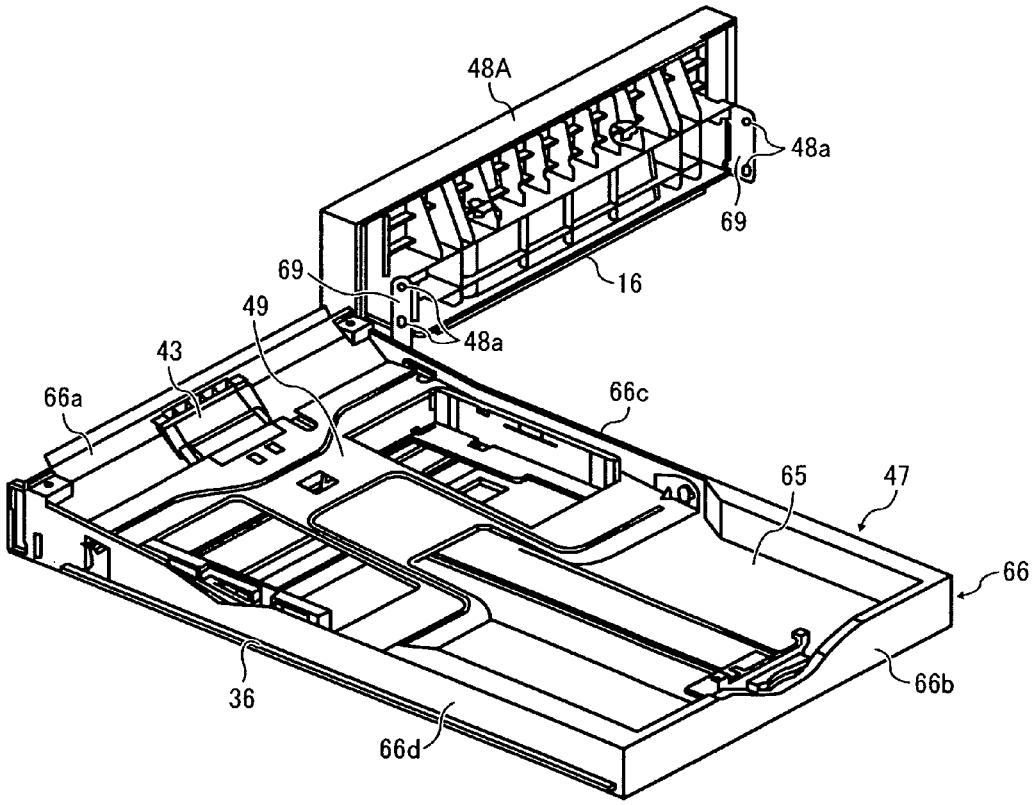
FIG. 4 is a perspective view illustrating the recording media container and a first exterior member.
Figure 5:
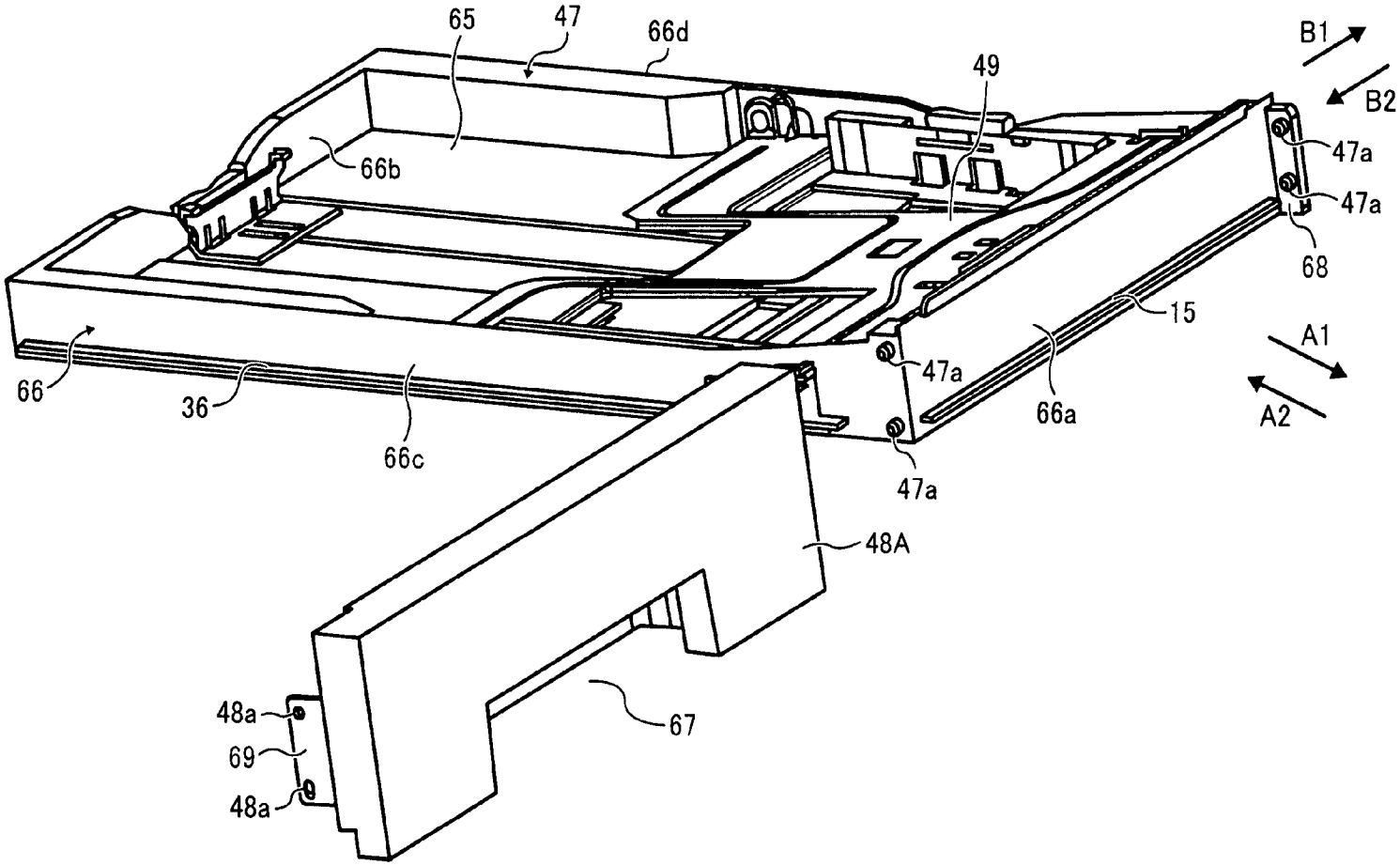
FIG. 5 is a perspective view illustrating the recording media container and the first exterior member of FIG. 4, viewed from a different angle.

As illustrated in FIGS. 4 and 5, the recording media container 47 includes a floor 65 and a peripheral wall assembly 66 along an outer circumference of the floor 65. The peripheral wall assembly 66 includes a front wall 66*a*, a rear wall 66*b*, and a pair of opposed side walls 66*c* and 66*d*, spaced apart from each other. The floor 65 includes a bottom plate 49 to lift up a downstream side of the stack of recording media accommodated in the recording media container 47.

The front wall 66*a* includes a first exterior member (exterior plate) 48A, in a lower center portion of which a handle 67 is provided for pulling the drawer out. The first exterior member 48A is mounted on the front wall 66*a* via a container-side engaging member formed on the recording media container 47 and an exterior-side engaging member formed on the first exterior member 48A. In this embodiment, the container-side engaging member means multiple pin members 47*a* and the exterior-side engaging member means respective engaging holes 48*a* that are removably engaged with the pin members 47*a*.

Specifically, one pair of pin members 47*a* is formed vertically on the side wall 66*c* of the recording media container 47 in the vicinity of one end of the front wall 66*a* and another pair of pin members 47*a* is formed vertically on a projecting tab 68 that projects from the side wall 66*d* in the vicinity of the other end of the front wall 66*a* of the recording media container 47. In this case, each pin member 47*a* projects in the direction B2 as shown in FIG. 5.

Further, spaced tabs 69 are disposed at both lateral ends of a back side of the first exterior member 48A, and each of the tabs 69 has a pair of engaging holes 48*a* formed therein. In this case, the pin members 47*a* mounted on the side wall 66*c* and the pin members 47*a* mounted on the side wall 66*d* are displaced in the sheet conveyance direction.

Accordingly, as the first exterior member 48A slidably moves along the front wall 66*a* of the recording media container 47 toward the recording media container 47 in the direction B1 as illustrated in FIG. 5, the pin members 47*a* can engage with the respective engaging holes 48*a*. By so doing, each time the first exterior member 48A is pulled in the direction A1 or pushed in the direction A2, the recording media container 47 moves together with the first exterior member 48A. That is, in movement of the recording media container 47 in the first detaching and attaching operation via the first exterior member 48A (movement using the handle 67 of the first exterior member 48A), the first exterior member 48A and the recording media container 47 can be removed or inserted together in the first detaching and attaching operation.

Meanwhile, with the first exterior member 48A attached to the recording media container 47 as illustrated in FIGS. 2, 3, 6, and 7, when the recording media container 47 is pulled from the first exterior member 48A in the direction B1, the first exterior member 48A and the recording media container 47 are separated as illustrated in FIGS. 4 and 5.

To separate the first exterior member 48A and the recording media container 47 smoothly, the recording media container 47 has a guide rail 15 at the lower portion of the outer surface of the front wall 66*a* and the first exterior member 48A has a guide rail guide 16 to receive or slidably engage with the guide rail 15, as illustrated in FIGS. 4 and 5. Namely, with the recording media container 47 contained in the frame 10 of the sheet supplying device 100, as illustrated in FIG. 2, and the guide rail 15 of the recording media container 47 held on the guide rail guide 16 of the first exterior member 48A, if the recording media container 47 is pulled or removed in the direction B1, the guide rail 15 slidably moves on the guide rail guide 16 to separate the first exterior member 48A.

By contrast, with the recording media container 47 separated from the first exterior member 48A and the guide rail 15 placed on the guide rail guide 16, if the recording media container 47 is inserted into the first exterior member 48A in the direction B2, the guide rail 15 slidably moves on the guide rail guide 16 to attach the recording media container 47 to the first exterior member 48A.

Figure 6:
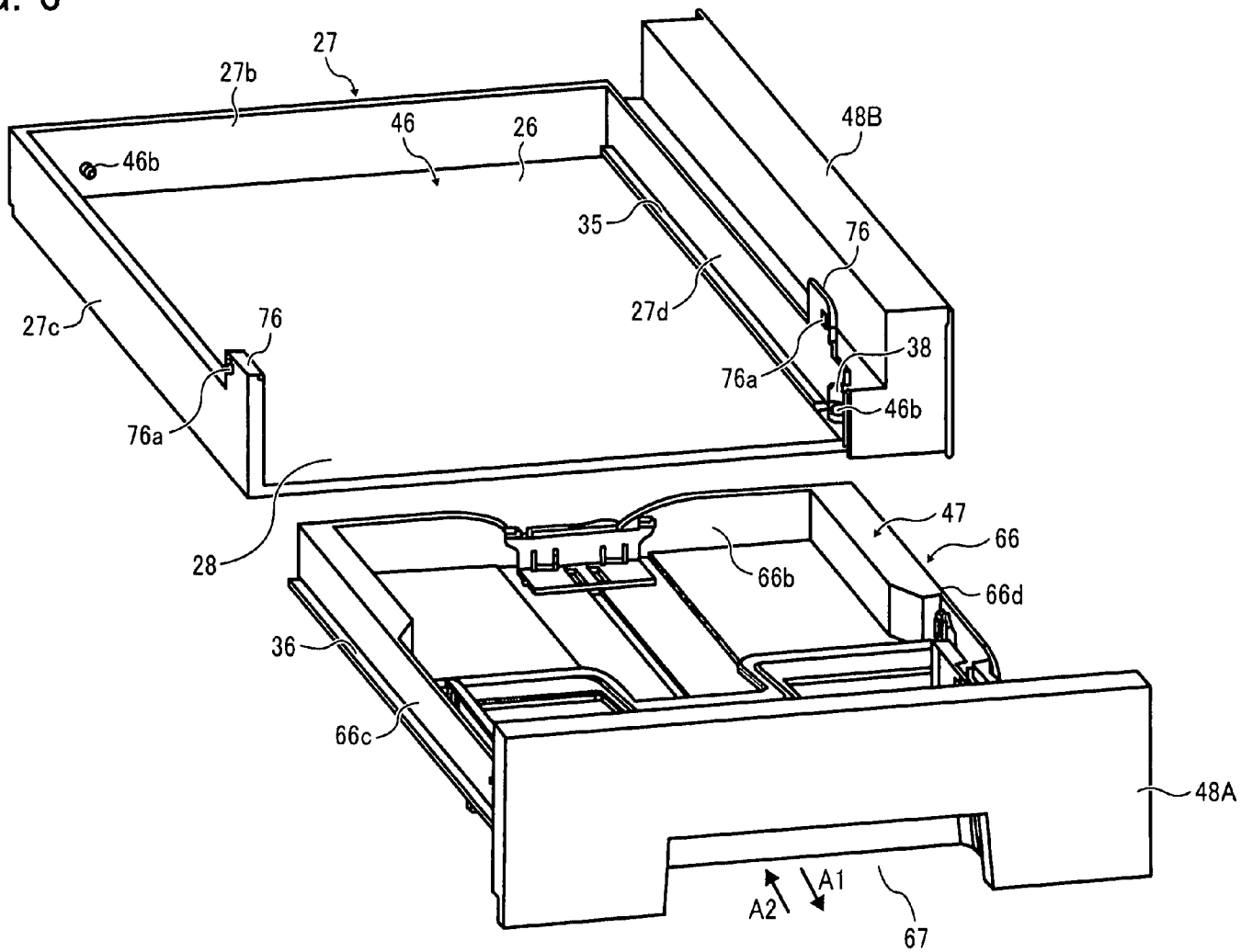
FIG. 6 is a perspective view illustrating the recording media container and a holder.
Figure 7:
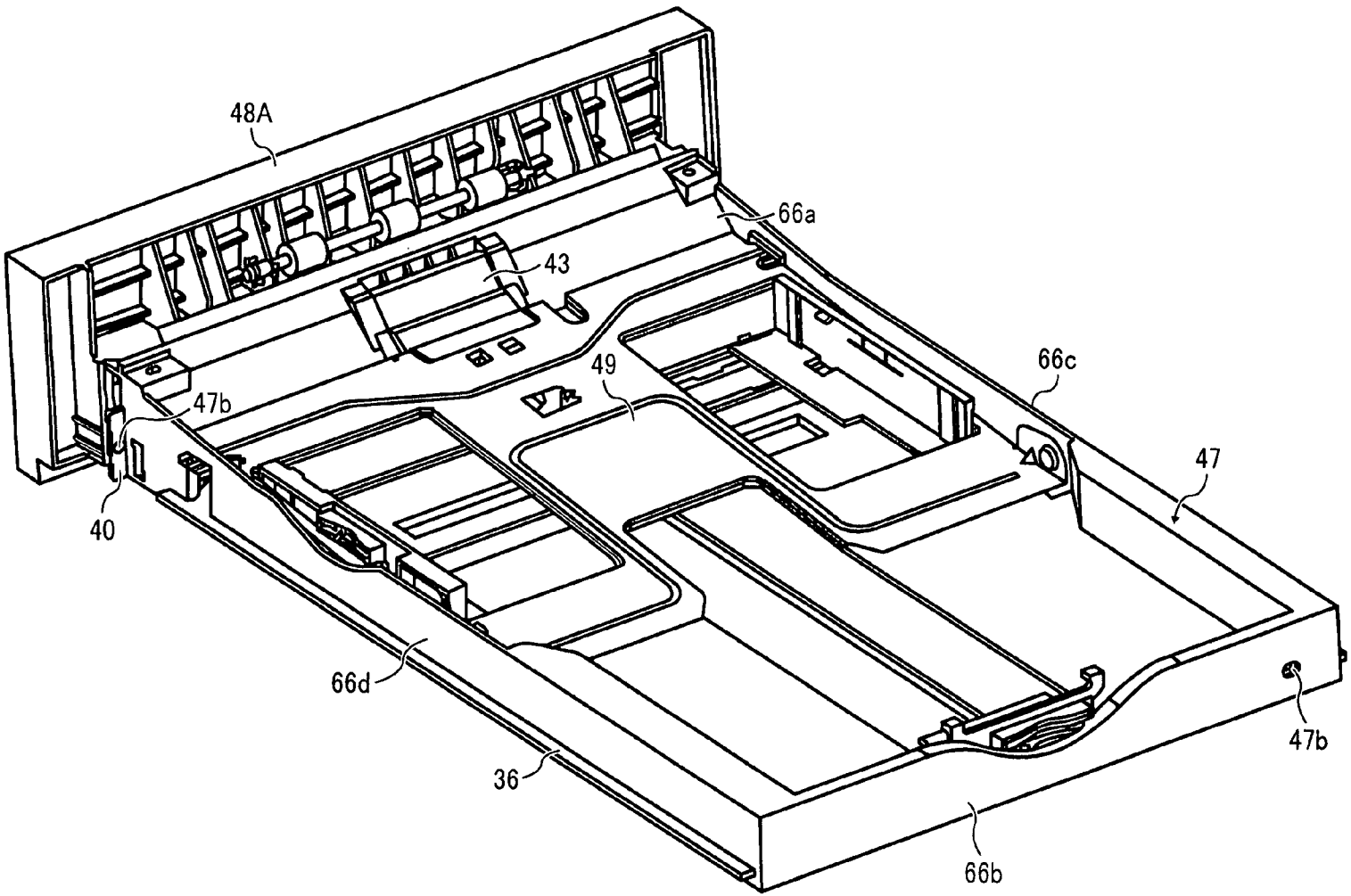
FIG. 7 is a perspective view of the recording media container, viewed from the rear side.

As illustrated in FIG. 6, the holder 46 that holds the recording media container 47 includes a floor 26 and a peripheral wall assembly 27 along an outer circumference of the floor 26. The peripheral wall assembly 27 includes a rear wall 27*b*, and a pair of opposed side walls 27*c* and 27*d*, spaced apart from each other, and one side with no wall formed functions as an opening 28 of the recording media container 47.

The holder 46 has respective guide rails 35 at the lower portion of the outer surface of the opposed side wall 27*c* and 27*d*, and the recording media container 47 has respective guide rail guides 36 to receive or slidably engage with the corresponding guide rails 35. In this structure, the distance between the inner sides of the opposed side walls 27*c* and 27*d* is made slightly greater than the distance between the outer sides of the opposed side walls 66*c* and 66*d*.

Specifically, with the recording media container 47 separated from the holder 46, as illustrated in FIG. 6, if the guide rail guides 36 of the recording media container 47 are placed on the guide rails 35 of the holder 46 to push the recording media container 47 with respect to the holder 46 in the direction A2, the guide rail guides 36 slidably move on the guide rails 35 to attach the recording media container 47 to the holder 46 so that the recording media container 47 can be held by the holder 46.

By contrast, with the recording media container 47 mounted on the holder 46 to be held thereby, if the recording media container 47 is pulled or removed from the holder 46 in the direction A1, the guide rail guides 36 slidably move on the guide rails 35 to detach the recording media container 47 from the holder 46.

The holder 46 includes a second exterior member (exterior plate) 48B on the outer side of the side wall 27*d*, and a handle 55 is mounted on the lower center portion of the front side of the second exterior member 48B for pulling the holder 46 out.

The holder 46 includes a holder-side locking member and the recording media container 47 includes a container-side engaging member. In this embodiment, the holder-side engaging member corresponds to multiple engaging pin members 46*b* and the container-side engaging member corresponds to respective engaging holes 47*b* that are removably engaged with the engaging pin members 46*b*.

One of the engaging pin members 46*b* is mounted on the rear wall 27*b* in the vicinity of the side wall 27*c* and the other is formed on a pin tab 38 that is mounted on the side wall 27*d* in the vicinity of the end of the opening 28.

One of the engaging holes 47*b* is formed on the rear wall 66*b* in the vicinity of the side wall 66*c* and the other is formed in an outwardly projecting tab 40 mounted on the side wall 66*d* of the recording media container 47 in the vicinity of the front wall 66*a*.

With this configuration, when the recording media container 47 is inserted into the holder 46 via the opening 28 to be mounted on the holder 46, the engaging pin members 46*b* of the holder 46 are engaged with the respective engaging holes 47*b* of the recording media container 47.

With the engaging pin members 46*b* engaged with the engaging holes 47*b*, when a user holds the handle 67 of the first exterior member 48A to pull out the recording media container 47 from the holder 46 in the direction A1, the recording media container 47 can be detached from the holder 46. By contrast, with the recording media container 47 separated from the holder 46, when a user touches the handle 67 of the first exterior member 48A to push the recording media container 47 into the holder 46 in the direction A2, the recording media container 47 can be held in the holder 46.

On the other hand, with the recording media container 47 held by the holder 46, the engaging pin members 46*b* of the holder 46 are engaged with the engaging holes 47*b* of the recording media container 47, and therefore the holder 46 and the recording media container 47 can move together, in a stable manner, to be inserted into or removed from the frame 10 of the sheet supplying device 100.

The sheet feeding roller 42 of the sheet feeding unit 4 includes a rotary shaft 75 that is pivotably supported at the upper portion of the opening 28 of the holder 46. Namely, as illustrated in FIG. 6, vertical tabs 76 are formed on the opposed side walls 27*c* and 27*d* at both ends of the opening 28, and include respective pivot holes 76*a* formed thereon, so that both ends of the rotary shaft 75 can be rotatably inserted into the pivot holes 76*a*. Therefore, the rotary shaft 75 is disposed along the directions B1 and B2.

Figure 8A:
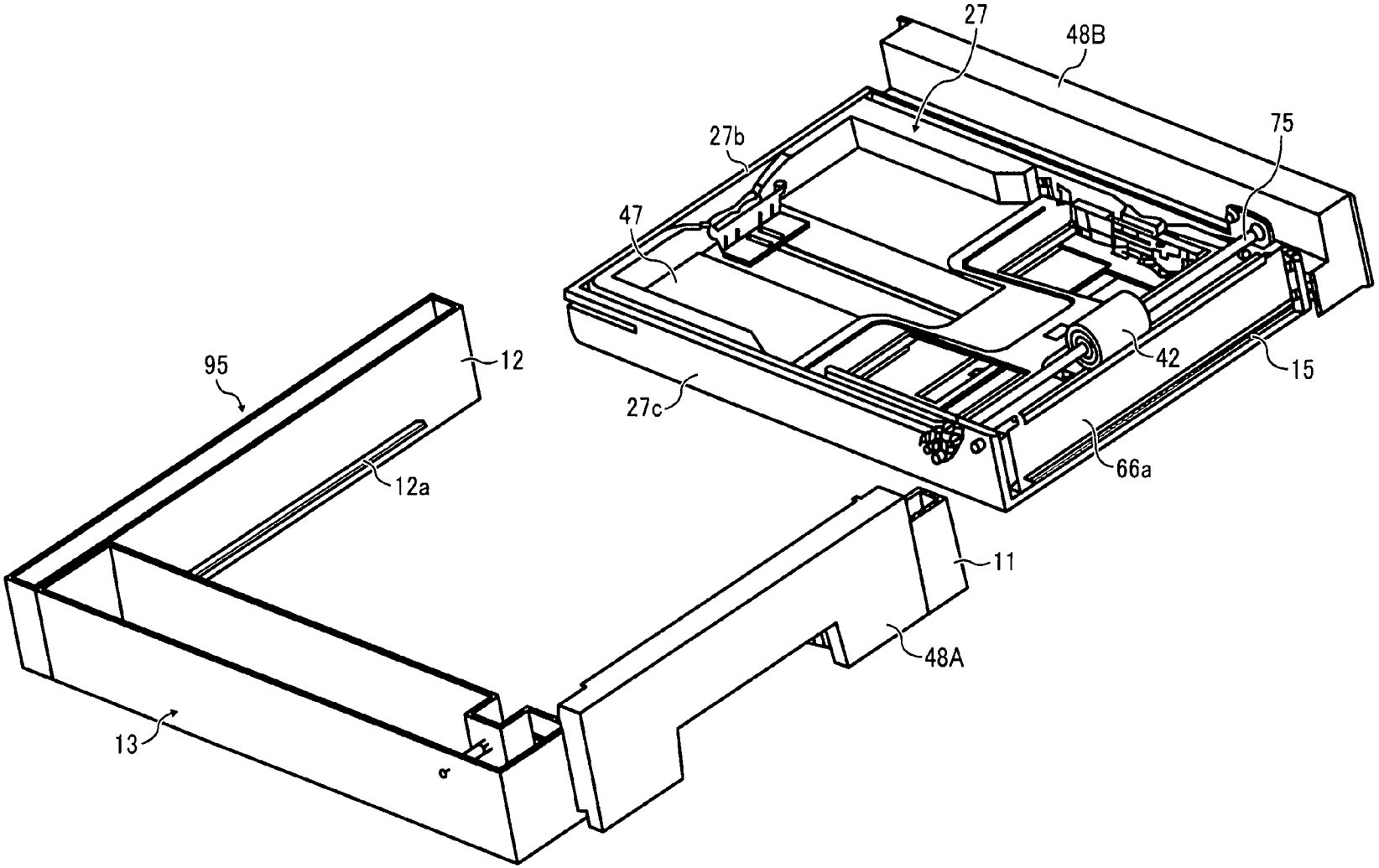
FIG. 8A is a perspective view of the sheet supplying device, in a state in which the recording medium container is pulled out along a direction perpendicular to the sheet conveyance direction.

As illustrated in FIG. 8, a gear member 78 is disposed at one end of the rotary shaft 75, which is opposite the other end in the vicinity of the second exterior member 48B and is connected to a rotary drive force transmission unit (e.g., a coupling) 79 provided on the frame 10 of the sheet supplying device 100. In this case, the gear member 78 is detachably attachable to the rotary drive force transmission unit 79 with the movement of the recording media container 47 in the second detaching and attaching operation.

Figure 8B:
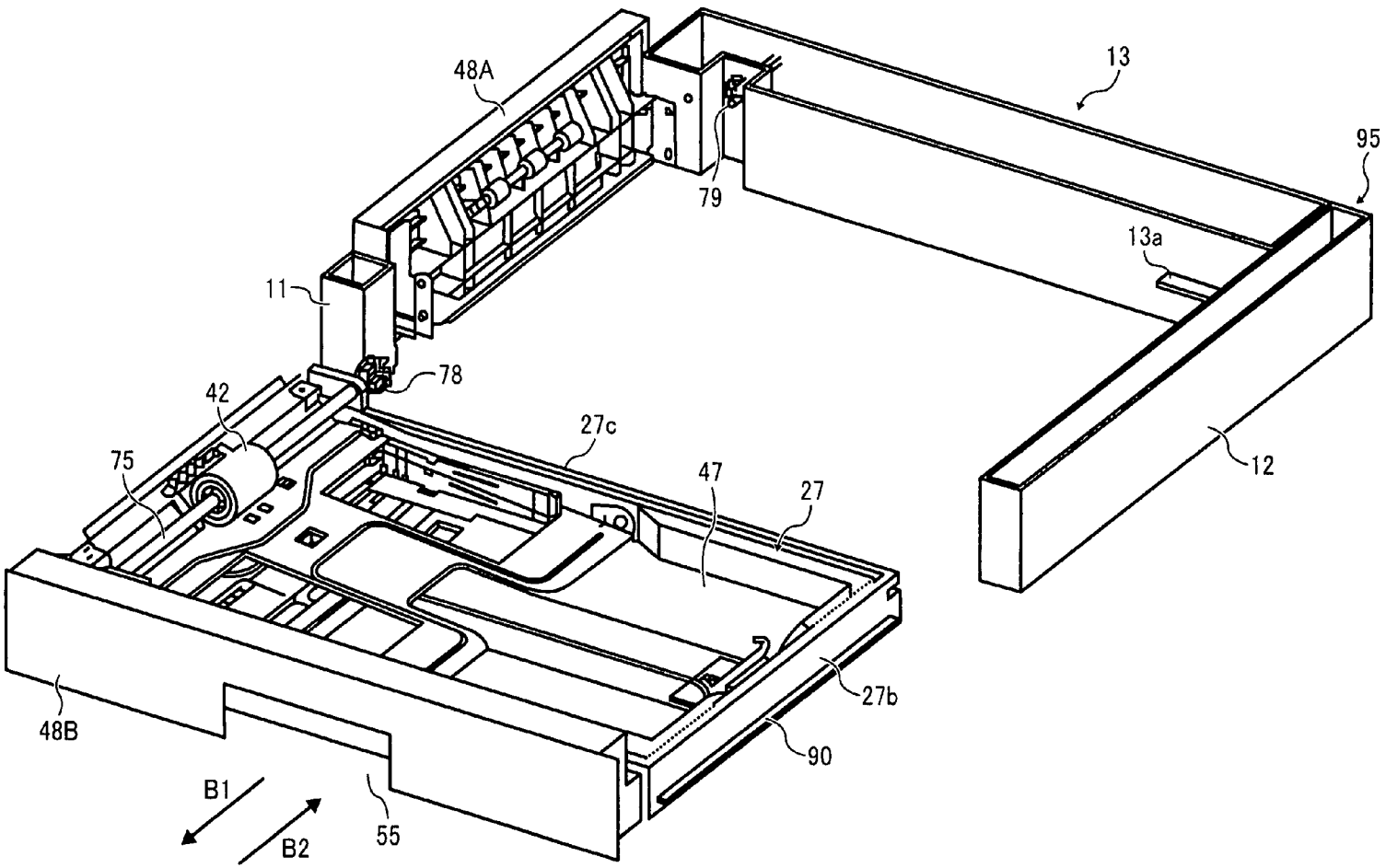
FIG. 8B is a perspective view of the sheet supplying device of FIG. 8A, viewed from a different angle.
Figure 8C:
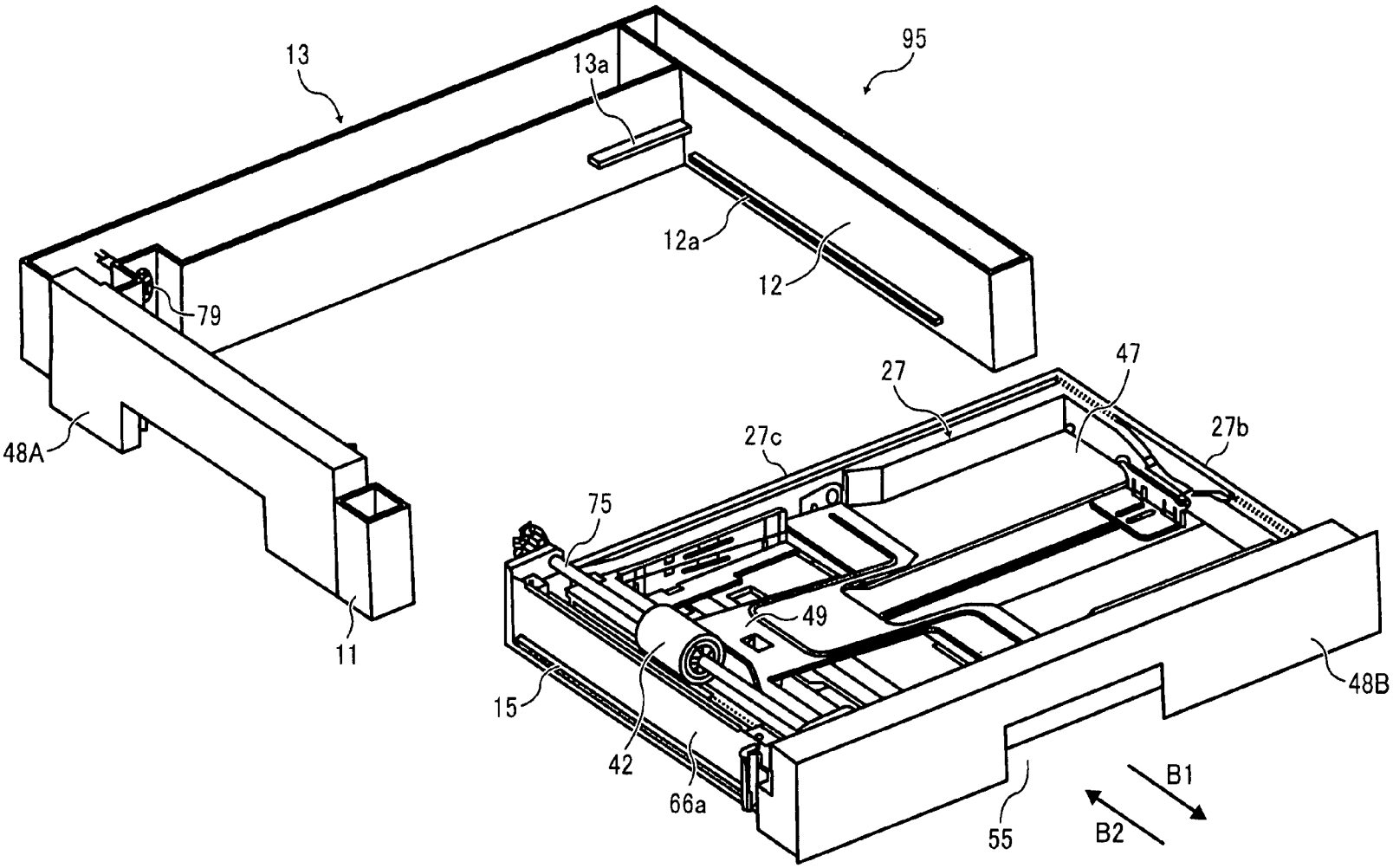
FIG. 8C is a perspective view of the sheet supplying device of FIG. 8A, viewed from a different angle.

Further, as illustrated in FIG. 8, the frame 10 of the sheet supplying device 100 includes a frame assembly 95 including a front pillar 11, a rear frame 12, and a side frame 13. The rear frame 12 includes a guide rail guide 12*a* formed at the lower portion of the inner surface thereof. Further, as illustrated in FIG. 8B, the rear wall 27*b* of the holder 46 includes a guide rail 90 formed at the lower portion of the outer surface thereof. The guide rail guide 12*a* receives or slidably engages with the guide rail 90.

In a case in which the recording media container 47 supported by the holder 46 is collected in the frame 10, with the first exterior member 48A remaining in the frame 10 and the opposite side of the side frame 13 being open, the guide rail 15 of the recording media container 47 is set on the guide rail guide 16 of the first exterior member 48A and the guide rail 90 of the rear wall 27*b* of the holder 46 is set on the guide rail 12*a* of the rear frame 12.

With this configuration, if a user holds the handle 55 of the second exterior member 48B to insert the recording media container 47 held by the holder 46 into the frame 10 in the direction B2, the guide rail 15 slidably moves on the guide rail guide 16 and the guide rail 90 slidably moves on the guide rail guide 12*a*, and therefore the recording media container 47 held by the holder 46 can be attached to the frame 10 reliably.

By contrast, if a user holds the handle 55 of the second exterior member 48B to pull out the recording media container 47 held by the holder 46 from the frame 10 in the direction B1, the guide rail 15 slidably moves on the guide rail guide 16 and the guide rail 90 slidably moves on the guide rail 12*a*, and therefore the recording media container 47 on the holder 46 can be removed from to the frame 10 reliably.

Figure 9:
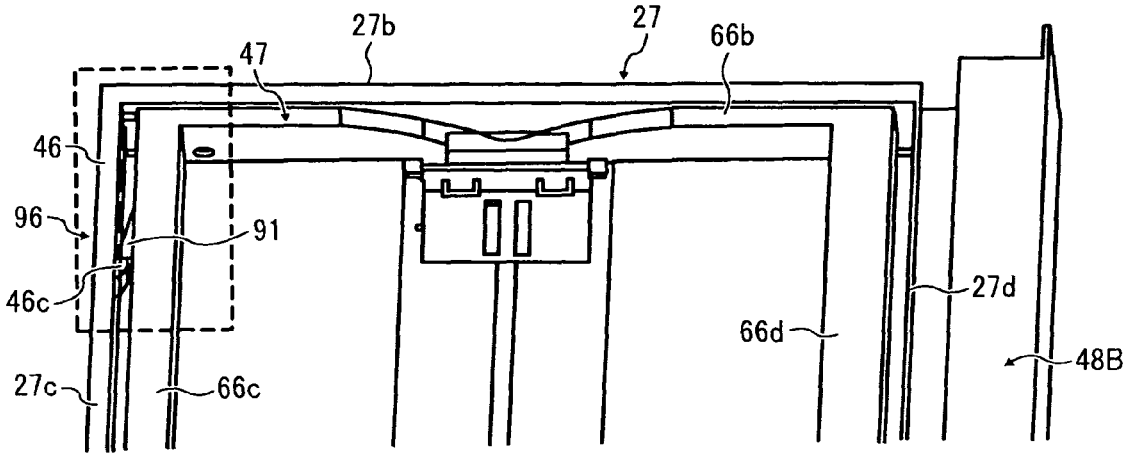
FIG. 9 is a partial plan view of the recording medium container and the holder.

The sheet supplying device 100 further includes a regulating unit 96 to regulate detachment of the recording media container 47 from the holder 46 when removing or pulling out the recording media container 47 in the second detaching and attaching operation, as illustrated in a dotted square in FIG. 9.

As illustrated in FIGS. 9 through 13, the regulating unit 96 includes a container-side anti-detachment member and a holder-side anti-detachment member. The holder-side anti-detachment member has a locking projection 46*c* that is mounted on the inner surface of the side wall 27*c* of the holder 46, protruding inward to the recording media container 47. The locking projection 46*c* includes an end surface 85*a* and a tapered (sloped) surface 85*b*. The end surface 85*a* extends from the inner surface of the side wall 27*c* in a direction perpendicular to the side wall 27*c*. The sloped surface 85*b* extends by inclining, in the first detaching and attaching operation, from the opening 28 of the holder 46 to the side wall 27*b* toward the recording medium container 47.

Figure 11:
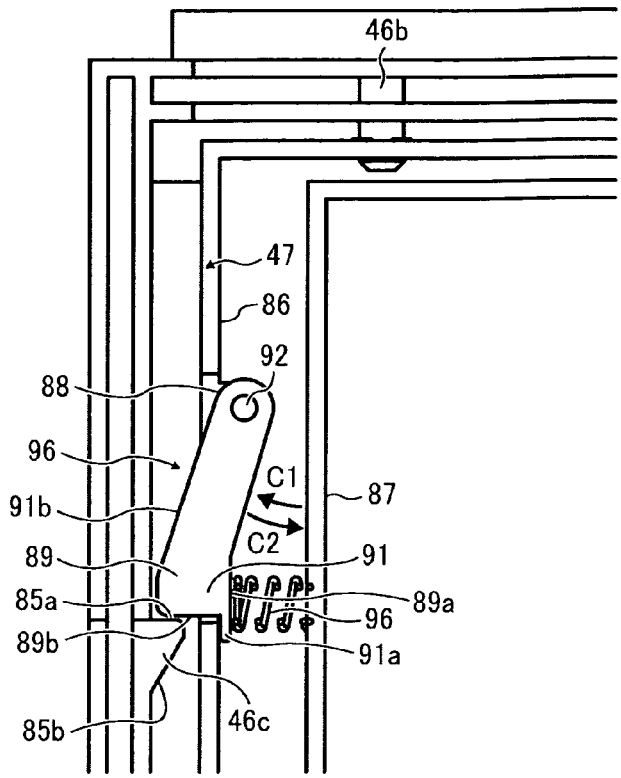
FIG. 11 is a cross-sectional view illustrating a schematic configuration of the regulating unit of FIG. 10.

Further, as illustrated in FIG. 11, the container-side anti-detachment member has a locking claw 91 that pivots in directions indicated by arrows C1 and C2 (hereinafter referred to as a direction C1 and a direction C2, respectively) about a pivot shaft 92 that is located closer to an inner side (the rear wall 66*b*) than to the locking projection 46*c*. In this case, the side wall 66*c* of the recording media container 47 includes an outer wall 86 and an inner wall 87. The outer wall 86 includes a notched portion 88 from which an edge locking portion 89 of the locking claw 91 protrudes beyond the outer wall 86 toward the side wall 27*c* of the holder 46.

The edge locking portion 89 of the locking claw 91 has a rectangular shape in a plan view and includes an biasing member 93 disposed between an inner surface 89*a* of the edge locking portion 89 and the inner wall 87 of the side wall 66*c* of the recording media container 47 disposed facing the inner surface 89*a* so that the locking claw 91 is elastically pressed by the biasing member 93 in the direction C1.

Further, the inner surface 89*a* includes a stopper 91*a* that protrudes toward the leading edge of the locking claw 91, that is, the end opposite to the other end in the vicinity of the pivot shaft 92 is located. On contacting the stopper 91*a* with the outer wall 86, further movement or pivoting of the locking claw 91 in the direction C1 can be restricted.

With the stopper 91*a* contacting the outer wall 86, a leading end surface 89*b* of the leading edge engaging portion 89 of the locking claw 91 is disposed closely facing the end surface 85*a* of the locking projection 46*c*. Namely, the leading end surface 89*b* of the locking claw 91 and the end surface 85*a* of the locking projection 46*c* are closely disposed facing each other with a slight gap therebetween. In this state that indicates an anti-detachment state, an outer surface 91*b* except the leading edge engaging portion 89 of the locking claw 91 tapers to the side wall 27*c* of the holder 46 in a direction from the inward side (i.e., the rear wall 27*b*) toward the opening 28 of the holder 46.

Figure 15:
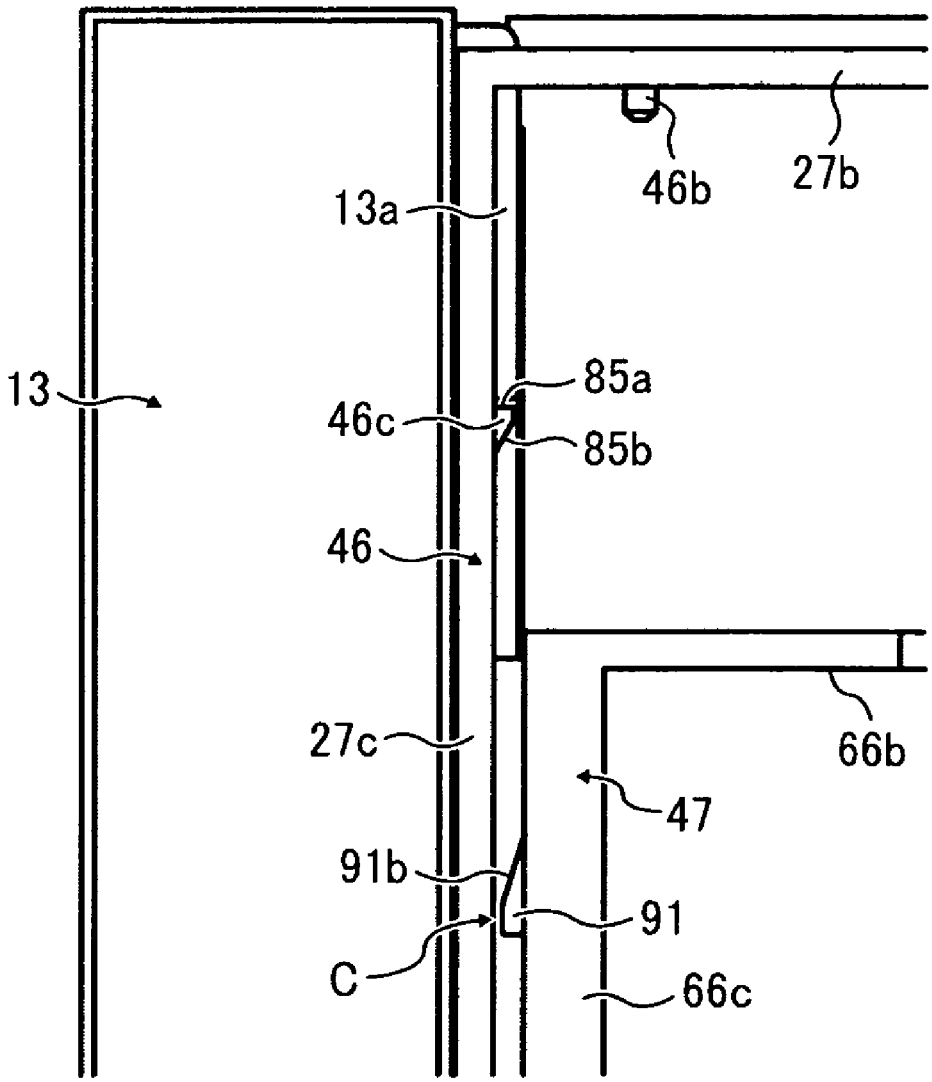
FIG. 15 is a plane view illustrating the sheet supplying device, in a state in which the holder is holding the recording media container.

Further, as illustrated in FIG. 15, a slight clearance C is provided between the locking claw 91 and the side wall 27*c* of the holder 46*c*. That is, the locking claw 91 and the side wall 27*c* of the holder 46 do not contact each other.

Figure 10:
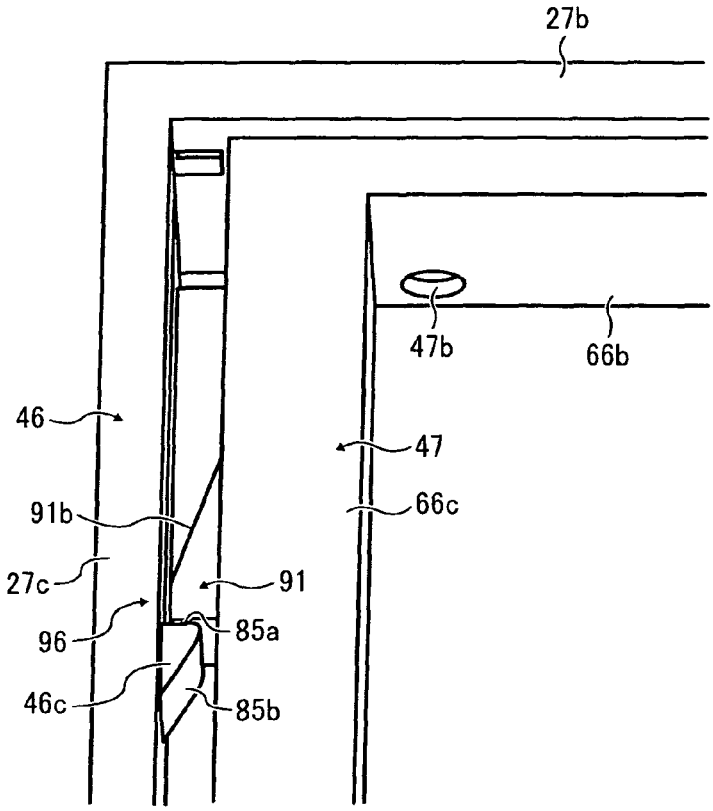
FIG. 10 is a perspective view illustrating a schematic configuration of a regulating unit.

Therefore, even if a user pulls the recording media container 47 from the holder 46 in the direction A1, as illustrated in FIGS. 10 and 11, the leading end surface 89*b* of the locking claw 91 comes into contact with the end surface 85*a* of the locking projection 46*c*, and therefore the user cannot remove the recording media container 47 from the holder 46.

Figure 12:
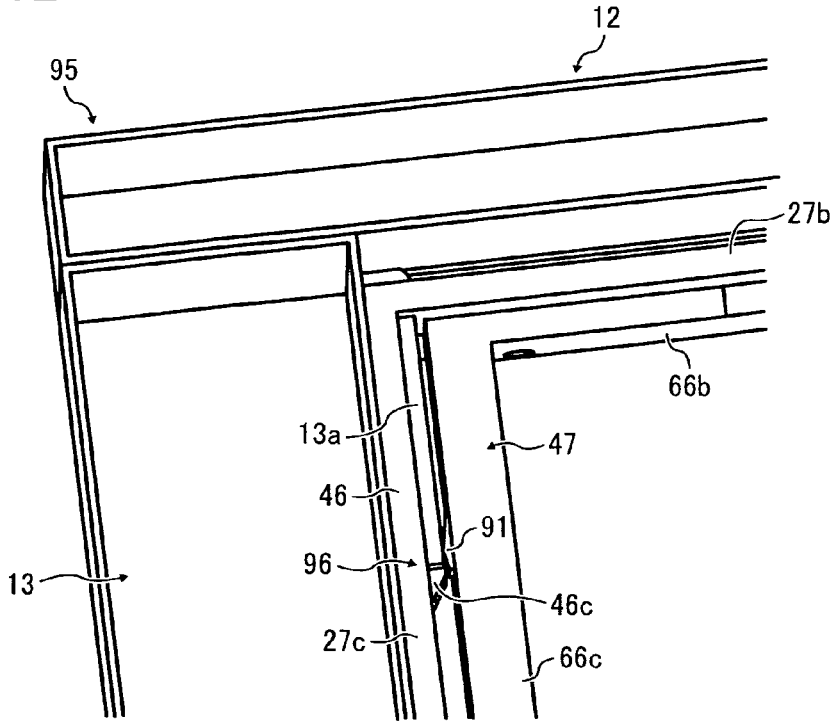
FIG. 12 is a perspective view illustrating the regulating unit of FIG. 10, in a state in which anti-detachment members are separated.
Figure 13:
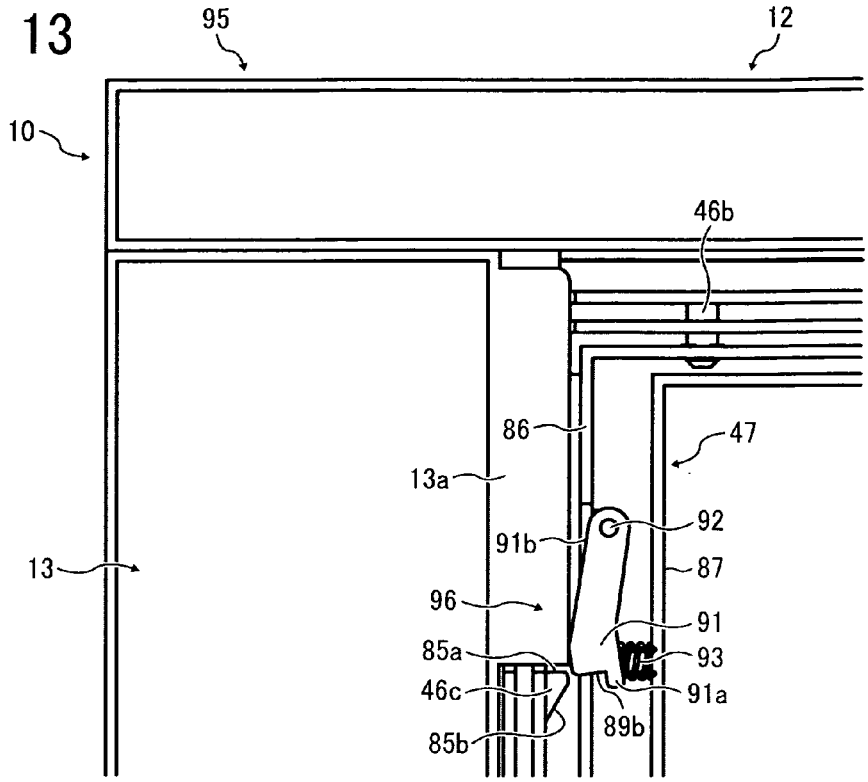
FIG. 13 is a cross-sectional view illustrating the regulating unit of FIG. 10, in a state in which anti-detachment members are separated.

Then, as illustrated in FIGS. 8, 12, and 13, the frame 10 of the sheet supplying device 100 further includes an unlocking member 13*a* on the inner surface of the side frame 13 of the frame assembly 95. The unlocking member 13*a* is configured to cancel the state in which the leading end surface 89*b* of the locking claw 91 and the end surface 85*a* of the locking projection 46*c* are disposed closely facing to each other with a slight gap therebetween.

The unlocking member 13*a* is a planar plate member extending in a longitudinal direction of the side frame 13 toward the rear frame 12 of the frame assembly 95. Further, as illustrated in FIG. 14, a space (for example, a slit 46*d* in this case) is formed from the side wall 27*c* of the holder 46 to the rear wall 27*b* in the vicinity of the side wall 27*c*.

Figure 14:
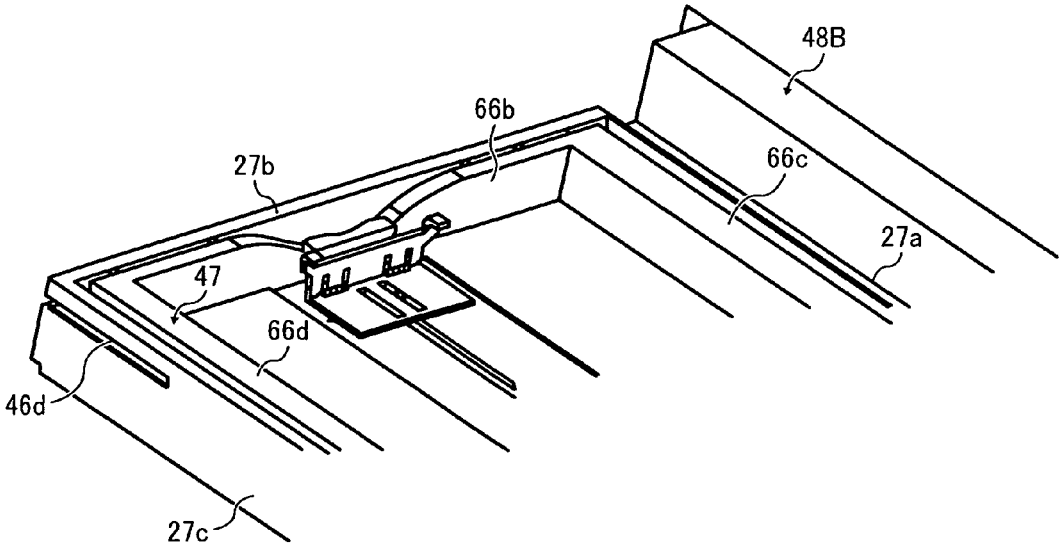
FIG. 14 is a perspective view illustrating the sheet supplying device, in a state in which the holder holds the recording media container.

Therefore, as illustrated in FIG. 14, with the recording media container 47 supported by the holder 46, when the recording media container 47 is attached to the frame 10 together with the holder 46, the unlocking member 13*a* presses the locking claw 91 through the slit 46*d* in the direction C2. In response to this action, the leading end surface 89*b* of the locking claw 91 and the end surface 85 of the locking projection 46*c* closely disposed facing each other are separated. This state indicates a detachment state.

Meanwhile, as illustrated in FIG. 15, if the first detaching and attaching operation is performed to push the recording media container 47 into the holder 46 that is accommodated in the frame 10, the sloped outer surface 91*b* of the locking claw 91 comes into contact with the sloped surface 85*b* of the locking projection 46*c*. Then, as the recording media container 47 is further inserted into the holder 46, the outer surface 91*b* is guided by the sloped surface 85*b* and the locking claw 91 swings about the pivot shaft 92 in the direction C2 so that the locking claw 91 can climb over the locking projection 46*c*. Thereafter, although the locking claw 91 tries to move in the direction C1, it cannot because the unlocking member 13*a* on the frame 10 reaches inside the holder 46 via the slit 45*d* and prevents the locking claw 91 from moving in the direction C1. Consequently, the leading end surface 89*b* of the locking claw 91 is separated from the end surface 85*a* of the locking projection 46*c*.

In this case, the clearance C resides between the locking claw 91 and the side wall 27*c* of the holder 46, and therefore the locking claw 91 that serves as a container-side anti-detachment member remains in a non-contact state with the holder 46 in the first detaching and attaching operation. Therefore, in detachment and attachment operations of the recording media container 47 in the first detaching and attaching operation, the locking claw 91 does not slidably contact the side wall 27*c* of the holder 46, which can prevent unnecessary wear on the locking claw 91.

By contrast, if the recording media container 47 supported by the holder 46 as illustrated in FIG. 2 is pulled out in the direction B1 in the second detaching and attaching operation, the recording media container 47 is removed together with the holder 46. In this case, the detachment of the recording media container 47 causes the unlocking member 13*a* mounted on the frame 10 of the sheet supplying device 100 to stop there. Therefore, the pressing force of the locking claw 91 in the direction C2 generated by the unlocking member 13*a* is gradually released, and then the locking claw 91 can swing in the direction C1 due to an elastic force (a restorative force) by the biasing member 93 until the stopper 91*a* contacts the outer wall 86.

Further, as the recording media container 47 is pushed together with the holder 46 in the direction B2 in the second detaching and attaching operation, the locking claw 91 comes into contact with the unlocking member 13*a*. As the recording media container 47 is further inserted into the frame 10 of the sheet supplying device 100, the leading end surface 89*b* of the locking claw 91 and the end surface 85*a* of the locking projection 46*c* are separated from each other, as illustrated in FIG. 13.

Therefore, when the recording media container 47 during the second detaching and attaching operation is being detached and completely pulled out, the recording media container 47 can be regulated and prevented from detaching from the holder.

As described above, the sheet supplying device 100 according to an embodiment of the present invention enables detachment and attachment of the recording media container 47 in two directions. With this configuration, the good operability of the recording media container 47 can be achieved in replacement of recording media and occurrence of the jam. Further, with this configuration, the sheet supplying device 100 can freely select the location of installation of the image forming apparatus. Furthermore, this configuration can achieve stable detachment and attachment of the recording media container 47 along the direction without providing a conventional mechanism for preventing a bottom plate. Therefore, the configuration of the image forming apparatus 1 can be simpler at lower costs.

By providing the holder 46 to hold the recording media container 47 by surrounding the outer circumference of the recording media container 47, the configuration of the frame 10, the configuration of the recording media container 47, and the configuration of the holder 46 can be made simpler, increasing productivity. Furthermore, the recording media container 47 can be moved in the two directions more stably and reliably. Specifically, in the movement of the recording media container 47 in the first detaching and attaching operation, the holder 46 remains attached to the frame 10 of the sheet supplying device 100. Therefore, only the recording media container 47 that is light in weight is moved, which can enhance the operability of detachment and attachment of the recording media container 47.

Since the sheet feeding unit 4 is integrally attached to the holder 46, the first detaching and attaching operation and the second detaching and attaching operation can be performed reliably, and the number of parts and components can be reduced for performing the operations.

By detaching and attaching the rotary shaft 75 of the sheet feeding unit 4 in the second direction, the rotary shaft 75 can be connected to or disconnected from the rotary drive force transmission unit 79. Therefore, even if the sheet feeding unit 4 is removed together with the recording media container 47 from the frame 10, when the recording media container 47 is inserted to the frame 10 to be attached thereto again, the rotary shaft 75 can be connected to the rotary drive force transmission unit 79 reliably, thereby providing good operability of detachment and attachment of the recording media container 47.

Since the rotary shaft 75 of the sheet feeding unit 4 is pivotably supported at the upper portion of the holder 46 in the vicinity of the opening 28, the rotary shaft 75 can be pivoted reliably, thereby conveying the recording medium reliably.

Since a sheet separation member, i.e., the separation pad 43 is fixed on the recording media container 47, the sheet supplying device 100 does not need to employ a conventional-type separation mechanism for separating the sheet feeding roller 42 of the sheet feeding unit 4 from the separation pad 43 that serves as a sheet separation member. This can reduce the number of components and parts used for the sheet supplying device 100 and simplify the configuration thereof, and therefore achieve cost reduction.

Further, the first exterior member 48A attached to the recording media container 47 can protect the front part (i.e., the front wall 66*a*) of the recording media container 47 when pulling the first exterior member 48A to detach the recording media container 47 from the frame 10 of the sheet supplying device 100, and enhance the rigidity of the recording media container 47 and further enhance the frame 10 and/or the holder 46 holding the recording media container 47 in the frame 10. Accordingly, even if the recording media container 47 is accommodated in the frame 10 or removed from the frame 10, the rigidity of the frame 10 can be maximized and the size of the sheet supplying device 100 can be minimized.

Further, the first exterior member 48A includes the handle 67 in the lower center portion thereof, and therefore the first detaching and attaching operation can be performed reliably, thereby achieving the speed-up of resupplying recording media in the sheet supplying device 100 and so forth.

Further, the container-side engaging member (i.e., the pin members 47*a*) engages with the exterior-side engaging member (i.e., the engaging holes 48*a*) in response to movement of the recording media container 47 to be inserted into the frame 10 in the direction B2 in the second detaching and attaching operation. Therefore, the first detaching and attaching operation and the second detaching and attaching operation can be performed reliably with a simple configuration. Furthermore, the simple configuration that may induce a reduction in highly accurate fasting parts can achieve cost reduction.

Further, the second exterior member 48B attached to the holder 46 can enhance the rigidity of the holder 46 and further hold the recording media container 47 in a stable manner, which can stabilize the movement of the recording media container 47 in the second detaching and attaching operation.

Further, the second exterior member 48B includes the handle 55 on the lower center part thereof, and therefore the second detaching and attaching operation can be performed reliably, thereby achieving the speed-up of resupplying recording media in the sheet supplying device 100 and so forth.

Further, the container-side engaging member (i.e., the engaging holes 47*b*) engages with the holder-side engaging member (i.e., the engaging pins 46*b*) in response to movement of the recording media container 47 to be inserted into the frame 10 in the direction B2 in the second detaching and attaching operation. Therefore, the first detaching and attaching operation and the second detaching and attaching operation can be performed reliably with a simple configuration, thereby enhancing the operability of detachment and attachment of the recording media container 47.

Further, the regulating unit 96 regulates and prevents the detachment of the recording media container 47 from the holder in the second detaching and attaching operation. Therefore, the recording media container 47 cannot be disengaged from the holder 46 in the second detaching and attaching operation, thereby providing the sheet supplying device 100 with the good operability of the recording media container 47.

Further, the regulating unit 96 includes a container-side anti-detachment member (i.e., the locking claw 91) and a holder-side anti-detachment member (i.e., the locking projection 46*c*). With this configuration, a user can replenish recording media in a stable manner and perform the second detaching and attaching operation without the need of carefully preventing detachment of the recording media container 47 from detaching from the holder 46. Accordingly, the first detaching and attaching operation and the second detaching and attaching operation can be performed in a stable manner.

The holder-side anti-detachment member of the regulating unit 96 is disposed upstream in the sheet conveyance direction, which corresponds to the direction of movement of the recording media container 47 during the first detaching and attaching operation, from the center of the opening 28 of the holder 46. Therefore, if the recording media container 47 is inserted into the holder 46 during the first detaching and attaching operation, when the container-side anti-detachment member comes to the position to face the holder-side anti-detachment member due to the insertion of the recording media container 47, the container-side anti-detachment member is pushed by the holder-side anti-detachment member to climb over the holder-side anti-detachment member, achieving the smooth insertion of the recording media container 47 during the first detaching and attaching operation. Furthermore, since the pivot shaft 92 is disposed upstream from the holder-side anti-detachment member in the sheet conveyance direction, the detachment of the recording media container 47 from the holder 46 can be prevented when regulating (locking) the movement of the recording media container 47. Therefore, the detachment and attachment of the recording media container 47 during the first detaching and attaching operation can be performed smoothly and reliably, thereby achieving good operability of the recording media container 47.

Further, the sheet supplying device 100 includes the biasing member 93 by which an unpredictable detachment of the recording media container 47, enhancing the operability of the recording media container 47. The sheet supplying device 100 further includes the unlocking member 13*a* by which the recording media container 47 can be detached from the holder 46 reliably during the first detaching and attaching operation. The unlocking member 13*a* is disposed upstream from the holder-side anti-detachment member in the sheet conveyance direction. Therefore, when the recording media container 47 can be slidably inserted into the holder 46 in the first detaching and attaching operation, the unlocking member 13*a* does not hinder the movement of the recording media container 47. By providing the space (i.e., the slit 46*d*) to the holder 46, the container-side anti-detachment member can be pressed by the unlocking member 13*a* reliably to disengage the recording media container 47 from the holder 46. The container-side anti-detachment member, which remains separated from the holder 46 and the holder-side anti-detachment member in the first detaching and attaching operation, can reduce the amount of unnecessary wear on the container-side anti-detachment member, and therefore can regulate or prevent the detachment of the recording media container 47 from the holder 46 in a stable manner.

Further, since the container-side anti-detachment member is covered from the inner surface of the recording media container 47, a user may not touch the container-side anti-detachment member when supplying or resupplying recording media in the recording media container 47. Therefore, the recording media container 47 cannot be separated from the holder 46 unexpectedly, thereby enhancing the operability of detachment and attachment of the recording media container 47.

Further, the slight clearance C is provided between the locking claw 91 and the side wall 27*c* of the holder 46. This configuration can retard wear on the locking claw 91 to provide stable functions of a locking mechanism for long. As described in an embodiment of the present invention, the space is formed in a shape of the slit 46*d* so that a user cannot touch the locking claw 91 via the slit 46*d*, thereby preventing an unexpected detachment of the recording media container 47 from the holder 46.

Further, the sheet supplying device 100 includes a guide mechanism with guide members such as guide rails 15, 35, and 90 and guide rail guides 16, 36, and 12*a*, and therefore the recording media container 47 can be moved smoothly during the first detaching and attaching operation in a stable manner, thereby providing good operability of detachment and attachment of the recording media container 47.

Obviously, with the sheet supplying device 100 with the above-described configuration, the image forming apparatus 1 can provide the good operability of the recording media container 47 and good functions to access to the recording container 47 of the sheet supplying device 100 in two different directions at low cost.

The configuration of the present invention is not limited thereto but can be modified without departing from the scope or spirit of the present invention. The image forming apparatus 1 according to the present invention can be an electrophotographic copier, a laser printer, a facsimile machine and so forth. Further, the space is not limited to the slit 46*d* but can be a partly modified or deleted peripheral assembly 66 of the holder 46. Accordingly, the unlocking member 13*a* is not limited to a plate-like or flat member but can be a shaft-like member. Further, the biasing member 93 is not limited to a coil spring but can be a different type of spring, a rubber material, a sponge and so forth.

In the above-described embodiment of the present invention, the locking claw 91 serving as a container-side anti-detachment member is disposed on the side wall 66*c* of the peripheral wall assembly 66 of the recording media container 47 and the locking projection 46*c* serving as a holder-side anti-detachment member is disposed on the side wall 27*c* of the peripheral wall assembly 27 of the holder 46. According to this configuration, the regulating unit 96 is provided to the side walls 66*c* and 27*c* with the recording media container 47 supported by the holder 46, as illustrated in FIG. 9. However, if possible, a regulating unit (i.e., the regulating unit 96) may be provided to the side walls 66*d* and 27*d*.

In the above-described embodiment of the present invention, the recording media container 47 can be removed from the frame 10 during the first detaching and attaching operation toward a downstream direction in the sheet conveyance direction. However, the direction of removal of the recording media container 47 during the first detaching and attaching operation is not limited thereto. For example, the recording media container 47 can be removed to an upstream direction in the sheet conveyance direction.

Further, the possible type of recording media used in the sheet supplying device 100 according to the present invention include standard sheets used for printing, 90K-type sheets (i.e., a batch of 1000 sheets weighting approximately 90 kg) such as OHP sheets, cards, and postcards, thick papers having a paper weight of sheet about 100 g/m$^2$ or greater, and special sheets with higher heat capacity than envelope and so forth.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet supplying device, comprising:

a recording media container to accommodate a stack of recording media therein;

a sheet feeding unit to feed a recording medium from the stack of recording media;

a frame to support the recording media container and the sheet feeding unit; and a holder to hold the recording media container by surrounding the outer circumference of the recording media container, the recording media container being detachably attachable to the frame in:

a first operation in which the recording media container is inserted into or removed from the frame in a direction parallel to a sheet conveyance direction in which the recording medium is fed and conveyed upstream or downstream by the sheet feeding unit, and the recording media container is separated from the frame and the holder remaining in the frame; and a second operation in which the recording media container is inserted into or removed from the frame in a direction perpendicular to the sheet conveyance direction, and the recording media container is separated together with the holder from the frame.

2. The sheet supplying device according to claim 1, wherein:

the holder comprises a holder-side engaging member; and the recording media container member comprises a container-side engaging member, the container-side engaging member engages with the holder-side engaging member when the recording media container is inserted into the frame in an attaching direction during the first operation, the container-side engaging member disengages from the holder-side engaging member when the recording media container is removed from the frame in a detaching direction during the first operation.

3. The sheet supplying device according to claim 2, further comprising a regulating unit to regulate detachment of the recording media container from the holder during the second operation of the recording media container with respect to the frame and in a state in which the recording media container is separated from the frame during the second operation.

4. The sheet supplying device according to claim 3, wherein:

the regulating unit comprises a container-side anti-detachment member on the container and a holder-side anti-detachment member on the holder locked with the container-side anti-detachment member in an anti-detachment state, the anti-detachment state is disabled to allow insertion and removal of the recording media container with respect to the frame during the first operation while the holder and the recording media container are attached to the frame, the container-side anti-detachment member and the holder-side anti-detachment member are in the anti-detachment state to regulate detachment of the recording media container from the holder during the second operation of the recording media container with respect to the frame and in a state in which the recording media container is separated from the frame during the second operation.

5. The sheet supplying device according to claim 4, wherein:

the holder-side anti-detachment member of the regulating unit is disposed upstream in the sheet conveyance direction from the center of the holder in the first operation, the container-side anti-detachment member includes a pivot shaft disposed upstream from the holder-side anti-detachment member in the sheet conveyance direction at a base portion of the container-side anti-detachment member around which the container-side anti-detachment member pivots to shift between the anti-detachment state and a detachment state in which the container-side anti-detachment member is unlatched from the holder-side anti-detachment member, in response to the insertion of the recording media container into the holder in the first operation, the container-side anti-detachment member is pressed by the holder-side anti-detachment member to climb over the holder-side anti-detachment member.

6. The sheet supplying device according to claim 4, wherein the regulating unit further comprises a biasing member to elastically bias the container-side anti-detachment member in a direction to produce the anti-detachment state.

7. The sheet feeding device according to claim 4, wherein the container-side anti-detachment member remains separated from the holder in the first operation.

8. The sheet feeding device according to claim 4, wherein the container-side anti-detachment member is surrounded by the recording media container.

9. The sheet supplying device according to claim 3, wherein:

the regulating unit comprises a container-side anti-detachment member on the container and a holder-side anti-detachment member on the holder locked with the container-side anti-detachment member in an anti-detachment state, the holder-side anti-detachment member of the regulating unit is disposed upstream in the sheet conveyance direction from the center of the holder in the first operation, the container-side anti-detachment member includes a pivot shaft disposed upstream from the holder-side anti-detachment member in the sheet conveyance direction at a base portion thereof around which the container-side anti-detachment member pivots to shift between the anti-detachment state and a detachment state in which the container-side anti-detachment member is unlatched from the holder-side anti-detachment member, in response to the insertion of the recording media container into the holder in the first operation, the container-side anti-detachment member is pressed by the holder-side anti-detachment member to climb over the holder-side anti-detachment member.

10. The sheet supplying device according to claim 9, wherein the regulating unit further comprises a biasing member to elastically bias the container-side anti-detachment member toward the anti-detachment state.

11. The sheet supplying device according to claim 3, wherein the regulating unit comprises:

a container-side anti-detachment member on the container and a holder-side anti-detachment member on the holder; and a biasing member to elastically bias the container-side anti-detachment member toward an anti-detachment state in which the container-side anti-detachment member and the holder-side anti-detachment member are locked together.

12. The sheet supplying device according to claim 11, further comprising a planar or shaft-like unlocking member to unlock the anti-detachment state of the recording media container with the holder remaining supported by the frame in the anti-detachment state by pressing the container-side anti-detachment member against an elastic force generated by the biasing member, wherein the recording media container is detached from the holder in the first moving direction in the detachment state with the regulating unit unlocked.

13. The sheet feeding device according to claim 12, wherein the unlocking member is disposed in the frame to press the container-side anti-detachment member via a slit in the holder.

14. The sheet feeding device according to claim 12, wherein the unlocking member is disposed upstream in the sheet conveyance direction from the holder-side anti-detachment member with the holder contained in the frame.

15. The sheet feeding device according to claim 14, wherein the unlocking member is disposed in the frame to press the container-side anti-detachment member via a slit in the holder.

16. The sheet supplying device according to claim 1, further comprising a regulating unit to regulate detachment of the recording media container from the holder during the second operation of the recording media container with respect to the frame and in a state in which the recording media container is separated from the frame during the second operation.

17. The sheet feeding device according to claim 1, further comprising a guide mechanism to guide the recording media container in the detaching direction and the attaching direction during the first operation, the guide mechanism comprising:

a guide rail on the recording medium container; and a guide rail guide on the holder to engage with the guide rail.

18. An image forming apparatus, comprising:

the sheet supplying device according to claim 1;

an image forming device to form an image on the recording medium fed from the sheet feeding device; and a sheet discharging device to discharge the recording medium with the image formed thereon.

* * * * *